US006134854A

United States Patent [19]

Stanchfield

[11] Patent Number: 6,134,854

[45] Date of Patent: Oct. 24, 2000

[54] GLIDER BAR FOR FLOORING SYSTEM

[75] Inventor: Oliver Stanchfield, Raleigh, N.C.

[73] Assignee: Perstorp AB, Perstorp, Sweden

[21] Appl. No.: 09/215,141

[22] Filed: Dec. 18, 1998

[51] Int. Cl.[7] ..... E04B 5/00

[52] U.S. Cl. ..... 52/480; 52/403.1; 52/590.1; 52/718.01; 52/747.1

[58] Field of Search ..... 52/211, 212, 290, 52/403.1, 480, 586.1, 590.1, 592.1, 718.01, 718.04, 747.1, 718.02, 718.05

[56] References Cited

U.S. PATENT DOCUMENTS

| | | | |
|---|---|---|---|
| 2,862,255 | 12/1958 | Nelson | 52/480 X |
| 3,045,294 | 7/1962 | Livezey, Jr. | 52/403.1 |
| 3,518,800 | 7/1970 | Tank | 52/480 |
| 4,170,859 | 10/1979 | Counihan | 52/586.1 X |
| 4,838,000 | 6/1989 | Ljungkvist . | |
| 4,940,503 | 7/1990 | Lindgren et al. . | |
| 5,299,402 | 4/1994 | Lee | 52/480 |
| 5,369,927 | 12/1994 | Counihan | 52/480 X |
| 5,465,546 | 11/1995 | Buse | 52/480 |
| 5,671,575 | 9/1997 | Wu | 52/480 X |
| 5,706,621 | 1/1998 | Pervan | 52/480 X |
| 5,706,623 | 1/1998 | Brown | 52/718.04 |
| 5,939,670 | 8/1999 | Shteynberg et al. | 52/718.04 X |

*Primary Examiner*—Beth A. Stephan
*Assistant Examiner*—Brian E. Glessner
*Attorney, Agent, or Firm*—Stevens, Davis, Miller & Mosher, L.L.P.

[57] ABSTRACT

A flooring system for use with floating floors is described which includes a glider bar having base portions including extending rails in the form of dovetail protrusions. The bases and rails are longitudinally moveable relative to anchoring plates, which anchoring plates are affixed to a subflooring. Flush finished floor moldings are slid longitudinally along the rails and are glued or mechanically fixed, at one side only, to the adjacent floating laminate flooring. By this assembly, smooth transitions between adjacent floating floors, or where floating floors meet another hard floor covering, or carpet, can be achieved. The system can also be used with flush stair nosing elements.

20 Claims, 4 Drawing Sheets

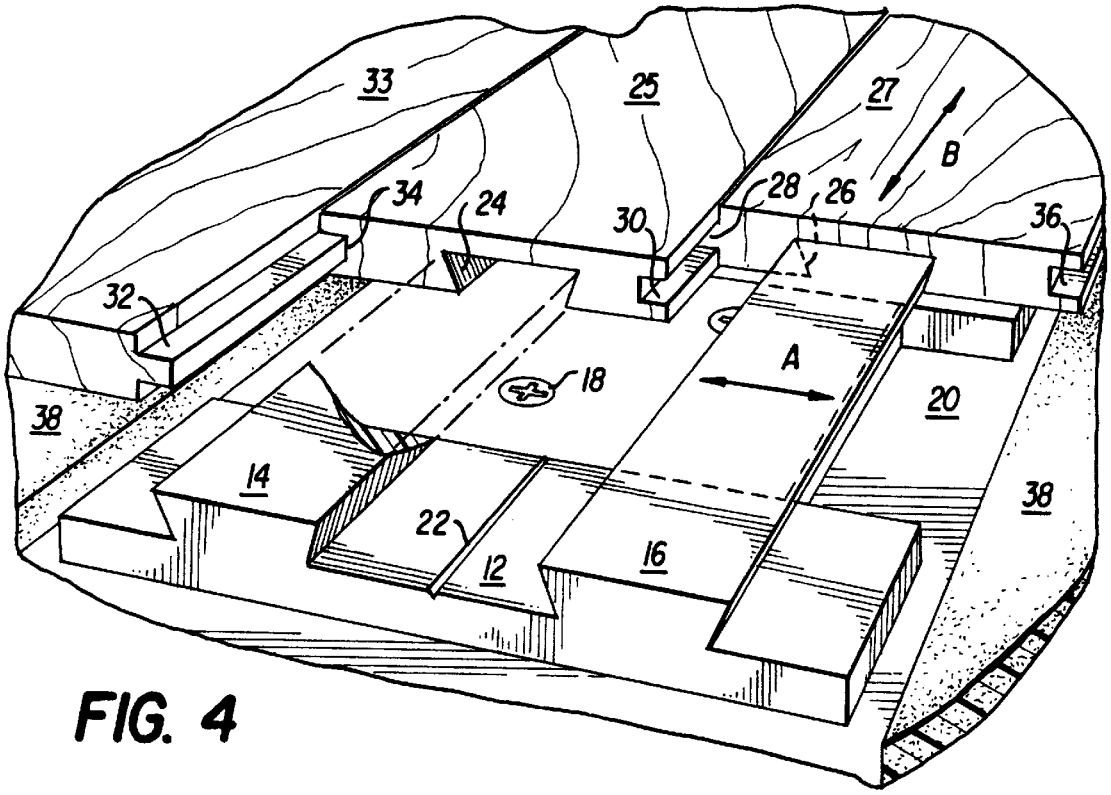
FIG. 4
FIG. 5
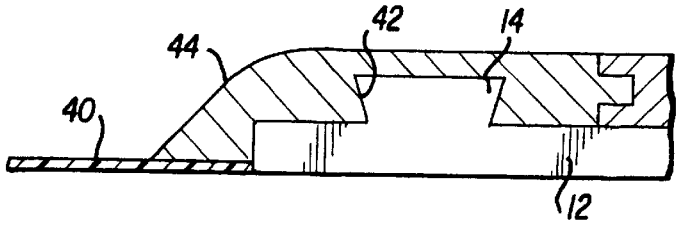
FIG. 6
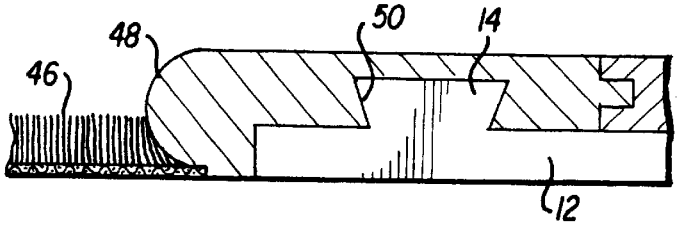
FIG. 7
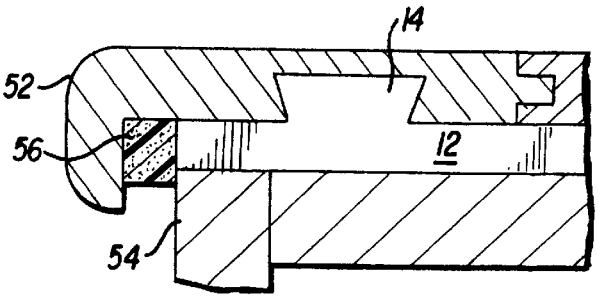

GLIDER BAR FOR FLOORING SYSTEM

BACKGROUND OF THE INVENTION

1. Field of the Invention

This invention relates to a device for use with a floating flooring system. Specifically, the device is hereafter refered to as a glider bar which can form flush transitions between floating floor sections of a laminate or wood flooring and can be used as an alternative to an overlapping T-molding; an overlapping stair nosing; an overlaping hard surface reducer or an overlapping carpet reducer.

2. Description of the Related Art

Laminate flooring having excellent abrasion resistant properties was invented by Kent O. Lindgren et al and described in U.S. Pat. No. 4,940,503, the entire disclosure of which is herein incorporated by reference. Such laminate flooring can be provided with tongue and groove elements so as to interfit with similar flooring elements to form a floor covering of high abrasion resistance.

This new laminate flooring material can be used as a substitute for conventional flooring materials, such as wood, stone, ceramic tile, etc. to simulate the appearance of such conventional materials and, in addition, has the capability of being provided in wide range of appearance, including fantasy designs by virtue of incorporation of a printed sheet visible under the upper surface which such natural materials as wood or stone, etc. could not duplicate.

In Europe, conventional flooring which is attached to a subfloor has evolved into a "floating" floor system. That is, unlike conventional wood, stone, etc., which is fastened to a subfloor by mechanical fasteners and/or adhesive, the "floating" floor of conventional wood or of laminated abrasion resistant properties is not attached to a subfloor, such as a concrete or wood subfloor.

A "floating" floor may have the components thereof attached to one another mechanically, such as with clips or other mechanical fasteners or by a mechanical joint of the floating flooring material itself, or to a system of floor planks that is only joined at the tongue and groove joint of each component of the floor planks with glue. While it may be installed over and attached to a floating underlay, such as foam, felt or other sound dampening material, it is held in place by gravity and not fixedly attached to a rigid underlayment, e.g. to a wood or concrete subfloor. A floating floor is a finished floor which is not attached in any way to the subfloor, i.e. the floor supporting materials beneath the floor itself. It is not attached to this subfloor with adhesives or mechanical fasteners or in any other way. A floating floor is only attached to itself, i.e. the joints of a floating plank, block or square are attached to themselves with glue at their common joints, or as an alternative to glue, then a mechanical fastener can hold the joints together without fastening the floor to the subfloor or a mechanical joint made of the same material as the finished floor that allows the joints to interlock to themselves. The floating floor is thus free to expand and contract according to the composition of the materials of that flooring. There is typically an expansion space around the perimeter of the rooms with floating floors as well as an expansion space around any fixed objects in that same room. This space allows the floating floor to expand and contract. Around the perimeter of such a floating floor, formulated from a series of planks or panels glued to corresponding planks or panels to form a continuous flooring, is an expansion space between the flooring and the walls of a room in which the flooring is installed. Such an expansion space, typically about ¼ inch, allows the floor to expand and/or contract, with changes in the environment, especially temperature and/or humidity.

As noted above, all of the joints in a floating floor are glued or mechanically fastened. In doorways, or archways, between rooms, where one floating floor joins another floor, an overlapping T-molding is used to conceal the expansion space and produce a flush finished flooring system between the two floors meeting in that doorway.

However, a T-molding creates a raised protrusion in the floor in the transition from one floor to another, and such an overlapping molding raised above the surface of a finished floor creates a surface that can collect dirt, is more difficult to clean, and, because it is raised, it is subject to more severe wear when struck by any object moving across the finished floor. Overlapping moldings can also be a tripping hazard, since they are a raised protrusion from the smooth finished flooring surface. Also, the transition is not waterproof and permits fluids to leak through the joint to the subflooring when the floating floors are subjected to routine maintenance, i.e. washing.

The glider bar of the invention also allows the contraction and expansion energies, forces, of a floating floor, to move freely within each room independent of any flooring transition moldings, i.e. hard surface reducers, carpet reducers, and stair nosings in that room or rooms. The glider bar also transfers the contraction and expansion energies, forces, of a floating floor, from one room to another when two floating floors join in narrow doorways or archways by providing both independent movement for each room and also by allowing and supporting, strengthening, the narrow doorway, or archway, joints so that those contraction and expansion energies can transfer from one room to the other.

Thus, the present invention is concerned with providing an alternative to the traditional moldings used with floating floors to overcome the deficiencies associated therewith.

OBJECTS OF THE INVENTION

It is thus, an object of the invention to provide a floating flooring system, especially a laminate floating flooring system, which does not have the drawbacks associated with traditional flooring systems.

It is a further object of the invention to provide a component of a floating flooring system in the form of a glider bar having universal application to provide flush transitions as an alternative to the previous overlapping moldings. Such a glider bar, by its structure, has the capacity to allow the floating floors to move in an infinite number of directions when jointed to a flooring transition such as the flush reducers or flush stair nosing.

These and further objects of the invention will become apparent when read in connection with the appended drawings and detailed description of the invention.

BRIEF DESCRIPTION OF THE DRAWINGS

FIG. 4 is an enlarged view of the flooring system of the invention in combination with a floating flooring to form a flush doorway transition;

FIG. 5 is an enlarged view of a portion of a glider bar in combination with a flush hard surface reducer;

FIG. 6 is an enlarged view of a portion of a glider bar in combination with a flush carpet reducer;

FIG. 7 is an enlarged view of a portion of a glider bar in combination with a flush stair nosing;

FIGS. 10*a*–10*h* show alternative means of fastening the glider bar to the subfloor or to fasten the finished floor transitions to the glider bar in place of the dovetail discussed hereinbelow.

DETAILED DESCRIPTION OF THE INVENTION

As hereinbefore described, floating flooring systems, when making a transition to another surface, such as another floating flooring, another hard surface, a carpet, etc. used a molding or transition element which overlaps the floating flooring. This overlapping element not only creates a raised protrusion which may create an unstable footing and be susceptible to damage but also is aesthetically unpleasing to the eye of the observer. The transition between adjacent rooms, such as where two floating floors meet, is unsightly and disturbed by a protruding molding, which may not match or compliment the appearance of the floating floors. Additionally, the gap, which is normally left between floating floors where they meet, as in a doorway, forms a joint which permits leakage of fluids, such as aqueous cleaning liquids which will collect in the underlayment of the floating floor.

To overcome these detriments, I have invented a glider bar 10, shown schematically in FIG. 1 which includes base portions 11, 12, 13 having raised rails, e.g. in the form of projecting dovetail portions 14, 16, the purpose of which will be hereinafter described.

Figure 1:
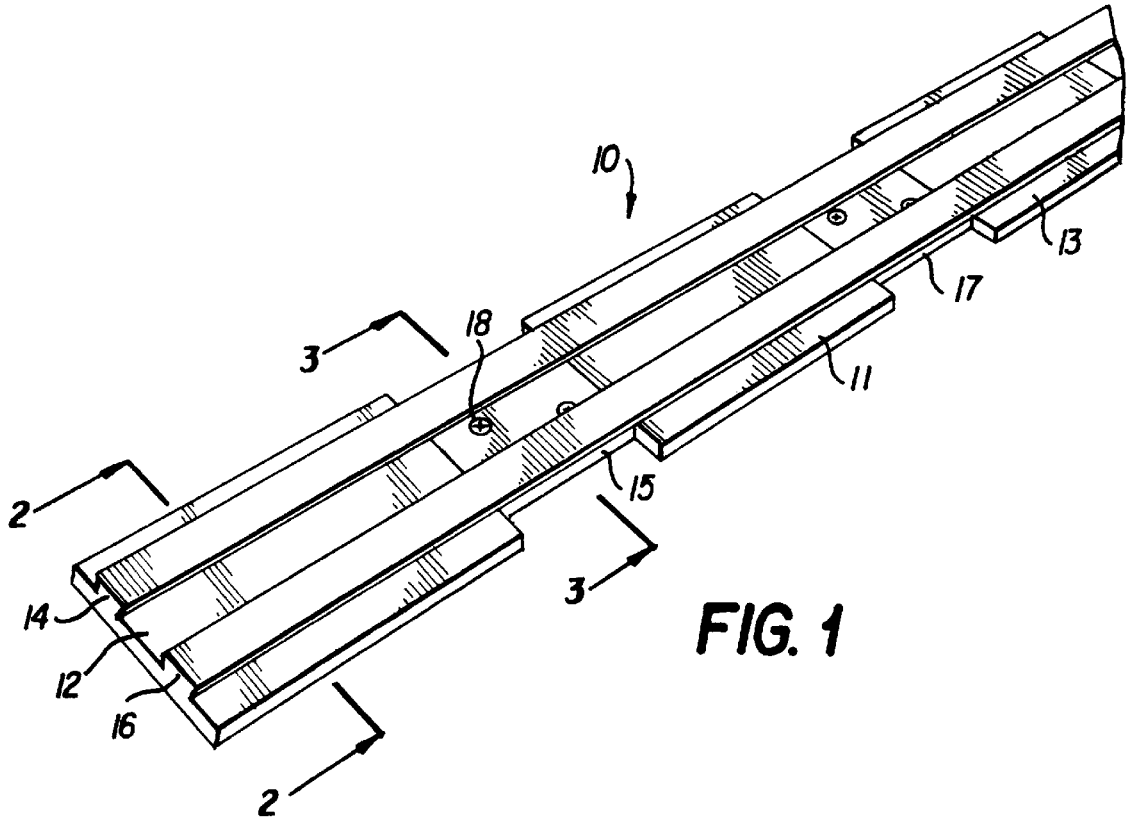
FIG. 1 is a schematic, perspective, partial view of a glider bar according to the invention.
Figure 2:
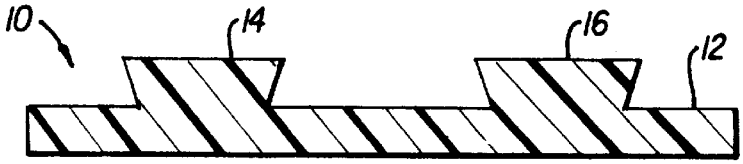
FIG. 2 is a sectional view through line A—A of FIG. 1.
Figure 3:
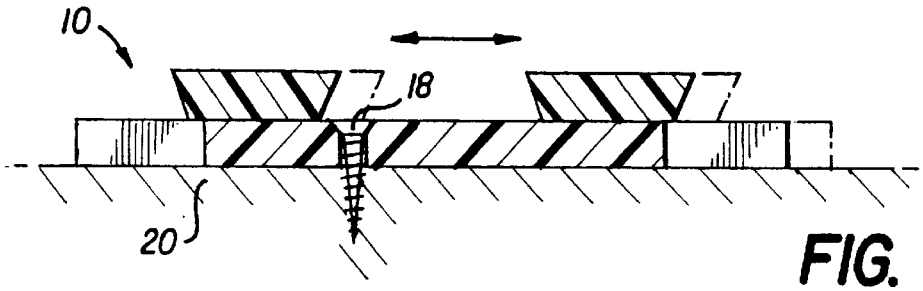
FIG. 3 is a sectional view through line B—B of FIG. 1.

Intermediate various base portions 11, 12 is anchoring plate 15 (anchoring plate 17 being shown between base portions 11, 13 in FIG. 1) provided with apertures through which fasteners pass to secure the anchoring plate to a subfloor 20. Fasteners may take the form of screws 18 or other similar elements. The apertures are preferably four in each anchoring plate, though only two fasteners are needed to secure the anchoring plate to the subfloor.

Typically, the glider bar 10 cannot be installed over carpet, carpet pad, or surfaces similar to carpet or carpet pad. The subfloor 20 must be a firm and solid surface formed of materials such as concrete, or other mineral based floorings, such as terazzo, marble or stone. Glider bar 10 can be installed over wood subfloors and finished floors that will be covered by a floating floor, such as hardwood, stripwood, linoleum, vinyl, ceramic or other hard surface materials.

EXAMPLES

The following examples illustrate the best mode of practicing the invention.

Subfloor 20 should be clean and the area where glider bar 10 is to be installed must be clean and smooth such that the glider bar 10 is free to move without any obstruction. In general, glider bar 10 can be installed over any surface over which a floating floor can be installed.

The timing of installation of the glider bar 10 relative to installation of the floating floor is flexible and can be installed before the floating floor is installed, or in some instances, can be installed after the floating floor is installed.

When the glider bar 10 is installed before the floating floor the following steps occurs:

If the glider bar 10 with its appropriate floor molding is to be installed in a doorway that has a door jamb and door casing, it is recommended to undercut the door jamb, stop and casings to the thickness of the floating floor to allow the floating floor to slide beneath the casings, jamb and stop. When the jamb and door stop is undercut to the thickness of the floating floor, this also allows the glider bar 10, when it is a doorway transition, to fit under the jambs, and door stop.

When the glider bar 10 is a hard surface reducer 44 or carpet reducer 48 (FIGS. 5 and 6, respectively), then a portion of the glider bar 10 is allowed to fit under the jambs and stop while most of the second portion, the reducer portions, fit firmly against that part of the jamb that is not undercut. This allows the attached floating floor to move freely in two directions and the reducer portions of the glider bar 10 to move in one direction, there being no need for the reducer portions to expand left or right and only the need for the reducer portions to move forward and backward with the expansion movement of the floating floor. See FIGS. 1, 2, 3 and 4. When the glider bar 10, has a stair nose molding 52 (FIG. 7), it can fit into those doorways as described above when they step down immediately from the doorway.

When the stair nose molding 52 is not in a doorway, a portion of the stringer or wall base is undercut to allow the flooring section of the glider bar 10 to move freely while most of the portion containing the stair nosing 52 is fit firmly against the stringer or wall base that is not undercut. This allows the attached floating floor to move freely in two directions and the stair nosing 52 portion of the glider bar to move in one direction, there being no need for the stair nosing 52 portion to expand left or right and only the need for stair nosing 52 portion to move forward and backward with the expansion movement of the floating floor.

Attaching the floating floor to the glider bar 10

When the glider bar 10 is already in place and the floating floor starts from the doorway, archway or step down or an open transition to another flooring surface then the plank, block or squares of the floating floor are aligned, cut and milled, if necessary, to fit into the glider bar molding. The floating floor, although fit, is not glued or attached in any way at this time to the glider bar 10. The glider bar molding is then moved away from the floating floor enough to leave a space between the floating floor and the glider bar molding sufficient to hold the base plate of an installation strap. Install the floating floor. When the floor is completed, remove the installation strap, glue and insert a loose tongue into the groove of either of the floating floor or glider bar molding, glue the second groove, then press together the glider bar molding and the floating floor. Clean up the glue residue if there is any glue ooze on the surface. To prevent glue that is seeping from the underside of the floating floor and glider bar molding joint from adhering to the glider bar frame a piece of paper can be placed directly beneath the joint so that it covers the glider bar frame and also captures any glue seeping from the underside of the joint.

When the glider bar 10 is already in place and the floating floor meets the glider bar 10 in the process of being constructed, such as a doorway in the side of a room where the plank, block or square meets the glider bar molding as each row is assembled, i.e. the short ends of rows of planks meet the glider bar 10, then each piece of the floating floor is cut and milled then installed, but not yet attached to the glider bar molding. After all of the rows are cut and milled and attached to the floating floor and the construction of the floating floor is past the doorway, archway or floor transition opening the glider bar molding can be attached to the floating floor then or when the floating floor is completed. It is attached in the same way as described above.

When the glider bar is already in place in an opening in the wall where the last room of the floating floor is to be installed at the doorway, archway or step down or an open transition to another flooring surface then the plank, block or squares of the floating floor are aligned, cut and milled, if necessary, to fit into the glider bar molding. Glue and insert a loose tongue into the groove of either the floating floor or glider bar molding, glue the second groove, then press together the glider bar molding and the floating floor. Clean up the glue residue if there is any glue ooze on the surface. To prevent glue that is seeping from the underside of the floating floor and glider bar molding joint from adhering to the glider bar frame a piece of paper can be placed directly beneath the joint so that it covers the glider bar frame and also captures any glue seeping from the underside of the joint.

There are some instances where the glider bar 10 can be installed after the floating floor is installed.

When a floating floor in one room is designed to join a floating floor in an adjoining room and they meet in a doorway or archway and the flush doorway transition, on glider bar 10, is used then one room may be complete up to the doorway or archway and then the glider bar doorway transition can be installed. Once it is installed, the second room must be installed beginning from the same doorway or archway.

When you install the glider bar 10 to the first completed room, the necessary preparatory steps are taken, undercutting any door jambs, stops and casings. Then the doorway transition is cut for the doorway or archway, moved so it abuts to the installed floating floor. The exposed edge of the completed floating floor that is to join the glider bar transition has been cut and milled to receive glue and a loose tongue. Once the glider bar 10 has been positioned, it is moved back sufficiently to apply glue and a loose tongue, glue and insert a loose tongue into the groove of either the floating floor or glider bar molding, glue the second groove, then press together the glider bar molding and the floating floor. Clean up the glue residue if there is any glue ooze on the surface. To prevent glue that is seeping from the underside of the floating floor and glider bar molding joint from adhering to the glider bar frame a piece of paper can be placed directly beneath the joint so that it covers the glider bar frame and also captures any glue seeping from the underside of the joint.

The second room then is started from the doorway, archway, the plank, block or squares of the floating floor are aligned, cut and milled if necessary to fit into the glider bar molding. These pieces are joined to the glider bar doorway transition. Glue and insert a loose tongue into the groove of either of the floating floor or glider bar molding, glue the second groove, then press together the glider bar molding and the floating floor. Clean up the glue residue if there is any glue ooze on the surface. To prevent glue that is seeping from the underside of the floating floor and glider bar molding joint from adhering to the glider bar frame, a piece of paper can be placed directly beneath the joint so that it covers the glider bar frame and also captures any glue seeping from the underside of the joint.

The connection between the glider bar 10 and the floating floor can also be made with a mechanical system rather than a gluing system. Clips, inserted mechanical joints in place of the tongue and groove, snap in tracks that hold the joints together and any other mechanical system may be employed to join the floating floor to the glider bar.

In operation, the glider bar 10 is assembled by attaching the anchoring plate 15 to the subfloor 20. A centerline 22 can be embossed on the bases 11, 12, 13 (and on the anchoring plate 15) to assist alignment of these components with the glider bar 10 with the center of a door jam or other transition.

The raised rails in the form of projecting dovetail portions 14, 16 are shaped to cooperate with complimentary grooves 24, 26 in flooring elements 25, 27 (FIG. 4) which are slid longitudinally along arrow B over the respective rails from an end of the glider bar 10 so as to be interlocked in a transverse direction represented by arrow A. Although dovetail portions 14, 16 and complimentary grooves 24, 26 are illustrated, any interlocking shape can be used. Some alternative shapes are shown in FIGS. 10(*a*)–10(*h*). The tongue 28 and groove 30 joint between flooring elements 25, 27 (FIG. 4) is not glued as in the other flooring element assembly as their positions are set relative to one another by dovetail portions 14, 16. However, the respective tongue 32 and groove 34 joint between floating floor element 33 and flooring element 25 is glued (or mechanically fastened) as is the respective groove 36 of flooring element 27 with the tongue (not shown) of the adjacent floating floor (not shown).

In this way, the floating floors meeting in a doorway are provided with a flush transition element in the form of glider bar 10 having flooring elements 25 and 27 attached to the respective floating floors by gluing (or mechanically fastening) and fixed relative to one another by dovetail projections 14, 16.

Figure 9:
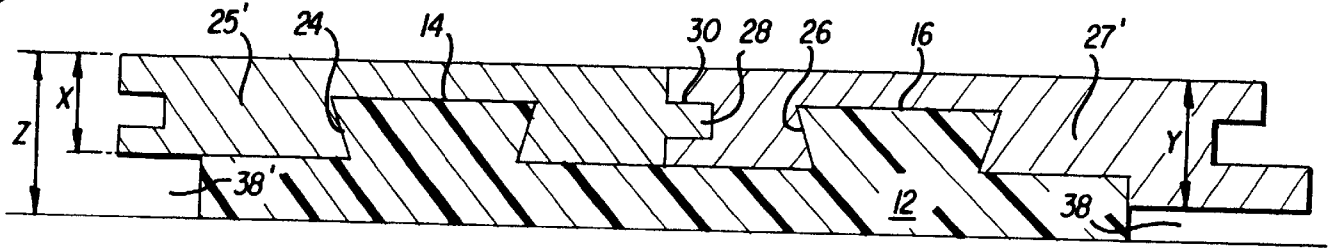
FIG. 9 is similar to FIG. 4, but shows how the glider bar can have universal utility by joining floors supported by underlayment of different thicknesses.
Figure 10E:
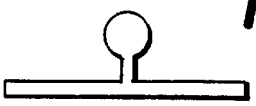
Figure 10E:
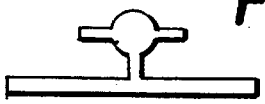
Figure 10E:
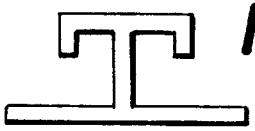
Figure 10E:
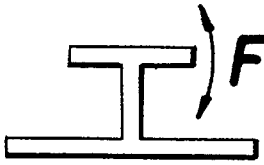
Figure 10E:
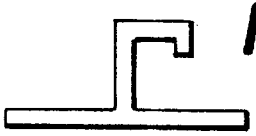
Figure 10E:
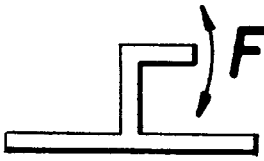
Figure 10E:
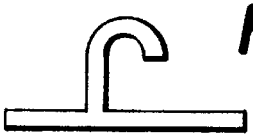
Figure 10E:
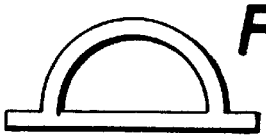
Figure 10E:
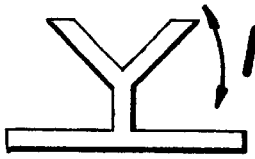
Figure 10G:
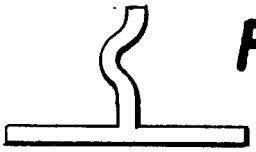
Figure 10G:
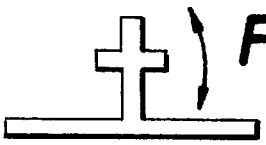
Figure 10G:
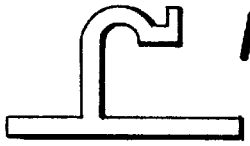
Figure 10H:
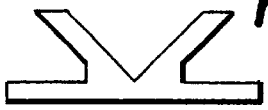

The underlayment 38 may be felt, foam, or other sound deadening material as in conventional floating floors. Differences in thickness of various underlayment 38 can be compensated by providing various thicknesses of flooring elements 25 and 27 of different thickness at their ends thereof remote from their joint 28, 30. As shown in FIG. 9, element 25' and element 27' have different thickness so as to provide a flush transition despite the fact that the underlayment 38', 38" under each floor is of different thickness.

Figure 8:
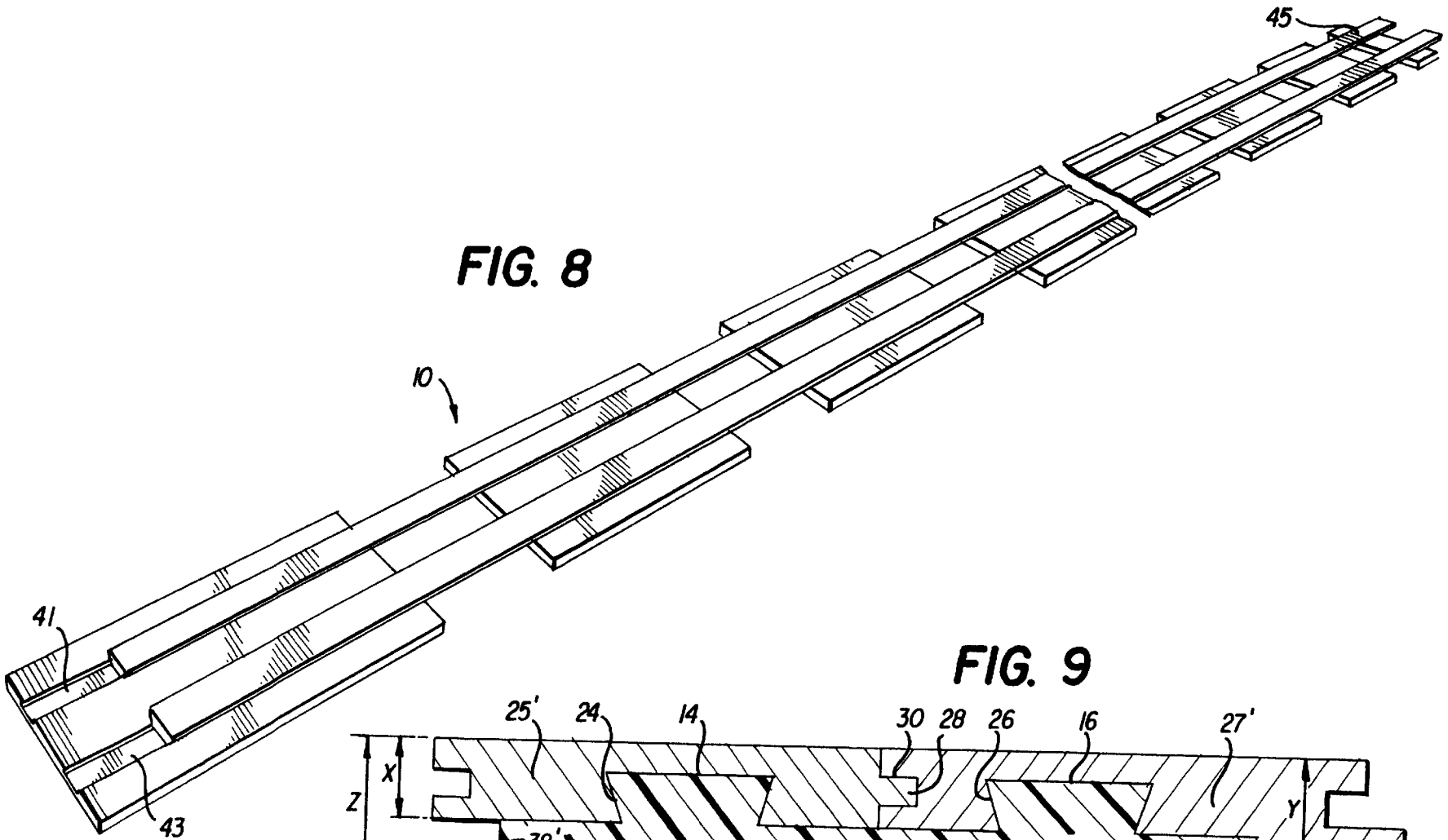
FIG. 8 is a perspective view of a glide bar showing provision of notches and extended rails at opposite ends thereof such that the glide bars can be assembled in tandem.

The anchoring plates 15, 17 are preferably provided with a beveled edge of 20° or so to allow the glider bar 10 to move in both the longitudinal (arrow B) and transverse (arrow A) directions. The anchoring plates 15, 17 are preferably square, e.g. 50 mm by 50 mm preferably containing four holes to permit insertion of one or more fasteners 18. The anchoring plates 15, 17 can be 4.5 mm thick or otherwise adjusted to match the thickness of the underlayment. Typical dimensions of a glider bar 10 can be 78 mm in width and 1200 mm in length, though, the ends of the glider bar 10 can be provided with male/female ends, e.g. two notches 41, 43 (FIG. 8) to mate with two extended rails 45, 47 at the opposite ends of glider bar 10, to be joined and used in tandem to form extended lengths where necessary, e.g. for an extended step, or in extended areas where a floating floor meets another floor covering surface, such as carpet, ceramic tile, stone or vinyl. Of course, the glider bar 10 can be cut to dimension when used in narrower dimensions, such as conventional 24 inch (610 mm), 30 inch (762 mm) and 36 inch (914 mm) doorways.

The glider bar 10 is fastened to the subfloor 20 with the anchoring plates 15, 17. These anchoring plates 15, 17 can be installed with screws 18, nails or adhesives (not shown). When the plates are anchored into concrete or any other mineral based flooring, stone, or ceramic, holes are drilled into these surfaces and a natural or synthetic plug is placed into the drilled hole. The mechanical fastener, screw 18, or nail that anchors the anchoring plates is then screwed or nailed into the plugged hole thereby securing the anchoring plates 15, 17 to the subfloor 20. The anchoring plates 15, 17 can also be anchored with specialty adhesives. When the anchoring plates 15, 17 are fastened over a wood subfloor the screws 18, or nails (not shown) can be directly screwed (or nailed) into the wood subfloor (or specialty adhesives may be used).

In embodiments where a floating floor meets another hard surface floor covering such as vinyl 40 (FIG. 5), dovetail 14 on base 12 is engaged with groove 42 of a flush hard surface reducer 44. Thus, a smooth transition is made from the floating floor to the other hard surface floor covering.

When the other floor covering is a carpet 46, a flush carpet reducer 48 having groove 50 to engage with dovetail 14 can be supplied (FIG. 6).

In the embodiment where the floating floor is used as a step covering (FIG. 7), the glider bar 10 is provided with a flush stair nosing 52 over stair subfloor 54. A flexible, compressible material 56 can be placed between flush stair nosing 52 and the riser 54.

In the foregoing embodiments, the flush doorway transition provided by flooring elements 25, 27 can be made to match or compliment the adjoining floating floors. The flooring elements 25, 27 can be made of the same abrasion resistant laminate as the floating floor, or in the case of the hard surface reducer 44, carpet reducer 48, or stair nosing 52 can be the same or provided with a greater degree of toughness and abrasion resistance to prevent damage and wear.

INDUSTRIAL APPLICABILITY

The glider bar 10 may be packaged with the finished floor molding, i.e. flush doorway transition, flush carpet reducer, flush hard surface reducer or flush stair nosing attached to the glider bar or separate from it. When the finished molding is attached, the installer can simply measure the size that is needed and cut both the finished floor molding and the glider bar at the same time. The anchoring plates that attach the glider bar to the subfloor can be attached to the glider bar with tape or packaged separately, with or without fasteners, such as screws. Should the finished floor molding come packaged unattached to the glider bar, the installer can assemble the finished floor molding onto the glider bar, then cut to size as described above, or separately cut the finished floor molding and glider bar.

It will be evident that the foregoing description can be subjected to modification by those skilled in the art without departing from the spirit of the invention.

I claim:

1. A floating flooring system which comprises a combination of a plurality of similar flooring components which are attached to one another at edges thereof so as to form a plurality of assembled flooring components, a subfloor upon which the resulting assembled flooring components are placed upon, but unattached, to said subfloor; a glider bar, and at least one finished floor molding, said glider bar comprising at least one anchoring plate attached to said subfloor, and base portions having raised rails, said raised rails having profiles to interfit with corresponding grooves in said finished floor molding, said finished floor molding being attached to an edge of said assembled flooring components.

2. The floating flooring system of claim 1 wherein the plurality of similar flooring components are selected from the group consisting of planks, squares and panels.

3. The floating flooring system of claim 1 wherein the similar flooring components are attached to one another with mechanical fasteners.

4. The floating flooring system of claim 1 wherein the similar flooring components are attached to one another with adhesive.

5. The floating flooring system of claim 1 wherein said raised rails are in the form of dovetails.

6. The floating flooring system of claim 1 wherein said finishing floor moldings are selected from the group consisting of a flush doorway transition, a flush carpet reducer, a flush hard surface reducer and a flush stair nosing.

7. The floating flooring system of claim 1 wherein the plurality of similar flooring components are each a laminate provided with a high abrasion resistant surface.

8. The floating flooring system of claim 1 wherein the finished floor molding is made of the same material as the flooring components.

9. A glider bar for use with a floating flooring system, said glider bar comprising a plurality of base portions, each of said base portions being spaced from an adjacent base portion, and having raised rails thereon, at least one anchoring plate intermediate one of said base portions and said adjacent base portion, said anchoring plate adapted to be attached to a subfloor, but slidably interfitting between said base portion and said adjacent base portion and supporting said raised rails, said raised rails having a profile to interlock with a corresponding groove in a finished floor molding.

10. The glider bar of claim 9 wherein the raised rails are in the form of dovetails.

11. The glider bar of claim 9, further comprising a finished floor molding, wherein said finished floor molding is one selected from the group consisting of a flush doorway transition, a flush hard surface reducer, a flush carpet reducer and a flush stair nosing.

12. The glider bar of claim 9, in combination with adjacent floating floors, wherein the glider bar transmits forces between said adjacent floating floors.

13. The glider bar of claim 12 wherein the adjacent floating floors are each installed over a floating underlay of different thickness.

14. The glider bar of claim 9 wherein the rails are continuous and the base is discontinuous and the anchoring plates occupy at least a portion of the space between discontinuous bases.

15. The glider bar of claim 9 wherein a centerline is embossed on the bases thereof.

16. The glider bar of claim 9 wherein a centerline is embossed on the anchoring plates.

17. A glider bar system for use with a floating flooring system, said glider bar system comprising a plurality of anchoring plates, a base portion having raised rails thereon, said base portion interfitting with said anchoring plates, said raised rails having a profile to interlock with a corresponding groove in a finished floor molding wherein the anchoring plates have edges which are beveled so as to allow the glider bar to move in both longitudinal and transverse directions.

18. A method of installing a flush molding on a floating floor, said method comprising providing a glider bar, said glider bar including anchoring plates, bases and raised rails on said bases, said rails defining an interlocking profile; sliding a flush molding along a longitudinal axis of said glider bar so as to engage said interlocking profile of said rails with corresponding grooves provided in said flush molding; fixedly attaching said anchoring plates to a sub-floor and placing said glider bar over said anchoring plates; and fixedly attaching said flush molding to at least one floating floor section.

19. The method of claim 18 wherein said flush molding is one selected from the group consisting of a flush stair nosing, a flush doorway transition, a flush carpet reducer and a flush hard surface reducer.

20. The method of claim 18 wherein said fixedly attaching is performed by adhesive or mechanical fastening.

* * * * *